US007751767B2

(12) United States Patent
Burton et al.

(10) Patent No.: US 7,751,767 B2
(45) Date of Patent: Jul. 6, 2010

(54) ROTATABLE AIR KNIFE

(75) Inventors: William A. Burton, Rochester, NY (US); Steven Russel, E. Bloomfield, NY (US); Lawrence A. Clark, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 972 days.

(21) Appl. No.: 11/470,647

(22) Filed: Sep. 7, 2006

(65) Prior Publication Data

US 2008/0063441 A1 Mar. 13, 2008

(51) Int. Cl.
*G03G 15/20* (2006.01)

(52) U.S. Cl. ..... 399/323; 271/309; 219/216

(58) Field of Classification Search ..... 399/323; 271/309

See application file for complete search history.

(56) References Cited

U.S. PATENT DOCUMENTS 4,061,330 A * 12/1977 Yanagawa ..... 271/309
6,032,004 A 2/2000 Mirabella, Jr. et al.
6,091,052 A * 7/2000 Matsuo et al. ..... 219/216
6,104,000 A * 8/2000 Aslam et al. ..... 219/216
6,385,405 B1 5/2002 Kingsland
6,990,751 B2 1/2006 Riley et al.
2003/0039491 A1 2/2003 Bogoshian
2003/0049042 A1 3/2003 Bogoshian
2003/0230843 A1 12/2003 Clark

* cited by examiner

*Primary Examiner*—David M Gray
*Assistant Examiner*—Roy Yi
(74) *Attorney, Agent, or Firm*—Gibb I.P. Law Firm, LLC

(57) ABSTRACT

Embodiments herein include an apparatus that can comprise any heating device, such as one having an outer surface adapted to contact items, such as sheets of print media, and a rotatable air outlet (vent, jet, blower, etc.) positioned next to the heating device. The air outlet can be, in one embodiment, part of a tube-shaped air pleneum. In some embodiments, the air outlet can comprise a slit, perforations, rows of jets, etc. and the air outlet can have a length at least as long as the width as the fuser. The rotatable air outlet can be positioned to blow air to remove the items from the heating device and can rotate from a first position to a different second position.

16 Claims, 6 Drawing Sheets

ROTATABLE AIR KNIFE

BACKGROUND

Embodiments herein generally relate to electrostatographic printers and copiers or reproduction machines, and more particularly, concerns an air knife used to lift media off heating devices such as fusers that has the ability to rotate.

In a typical electrophotographic printing process, a photoconductive member is charged to a substantially uniform potential so as to sensitize the surface thereof. The charged portion of the photoconductive member is exposed to a light image of an original document being reproduced. Exposure of the charged photoconductive member selectively dissipates the charges thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated or fused to permanently affix the powder image to the copy sheet.

The foregoing generally describes a typical black and white electrophotographic printing machine. With the advent of multicolor electrophotography, it is desirable to use an architecture which comprises a plurality of image forming stations. One example of the plural image forming station architecture utilizes an image-on-image (IOI) system in which the photoreceptive member is recharged, reimaged and developed for each color separation. This charging, imaging, developing and recharging, reimaging and developing, all followed by transfer to paper, is done in a single revolution of the photoreceptor in so-called single pass machines, while multipass architectures form each color separation with a single charge, image and develop, with separate transfer operations for each color.

In addition, as described in U.S. Pat. No. 6,385,405, the complete disclosure of which is incorporated herein by reference, direct marking technologies, and in particular ink jet printing, have emerged as printing alternatives that incorporate relatively simpler hardware requirements. However, images produced with the inks used in ink jet marking technologies, and particularly in thermal ink jet marking technologies, do not always exhibit the same high level of clarity or permanence as xerographically produced images. Therefore, as described in U.S. Pat. No. 6,385,405, ink jet printing can be combined with electrophotographic printing to fuse the ink onto the page.

In direct marking technologies, ink in the desired image is applied directly to the print medium. Various techniques of direct marking are well understood in the art. For example, the image may be applied by direct contact between a pen and the medium. Alternatively, ink jet recording techniques eject droplets of ink from a printhead onto the medium. Such ink jet techniques may include thermal ink jets, acoustic ink jet, piezo-electric ink jet printing, and others. Ink jet recording devices eject ink onto a print medium such as paper in controlled patterns of closely spaced dots. To form color images, multiple groupings of ink jets are used, with each group being supplied with ink of a different color from an associated ink container.

When performing the fusing of the image onto the sheet, a fuser typically fixes the toner layer with the embedded image onto the surface of the print medium. The fuser may be of the type conventionally used with xerographic printers. For example, the fuser may include a fuser roller and a pressure roller. The fuser roller may be heated to melt the toner, while the pressure roller presses the print medium against the fuser roller. The fuser roller may also be unheated. Those familiar with the xerographic printing arts will recognize that radiant fusing may also be used. Radiant fusing systems use intense light, such as a quartz rod to melt the toner and fuse it with the fibers of the paper. Those skilled in the art will also recognize that other fusing mechanisms used in the xerographic printing art may also be used.

SUMMARY

Embodiments herein include an apparatus that can comprise any heating device, such as one having an outer surface adapted to contact items, such as sheets of print media, and a rotatable air outlet (vent, jet, blower, etc.) positioned next to the heating device. The air outlet can be, in one embodiment, part of a tube-shaped air pleneum. In some embodiments, the air outlet can comprise a slit, perforations, rows of jets, etc. and the air outlet can have a length at least as long as the width as the fuser. The rotatable air outlet can be positioned to blow air to remove the items from the heating device and can rotate from a first position to a different second position.

In a more specific embodiment, the apparatus can comprise a fuser that has an outer surface adapted to contact sheets of print media, and the rotatable air outlet can be positioned next to the fuser. Again, the rotatable air outlet could be positioned to blow air to remove the sheets of print media from the fuser. In further embodiments, the air outlet can further comprise an actuator connected to the air outlet, and a controller connected to the actuator. The actuator can comprise a motor, a motor driven belt apparatus, etc. The controller can be adapted to actuate the actuator to rotate the air outlet from the first position to the second position.

In one example, when the air outlet is in the first position, the air outlet blows air at a first angle directly toward the outer surface of fuser, and when the air outlet is in the second position, the air outlet blows air at a second angle not directly toward the outer surface of the fuser. Thus, when in the first position, the air outlet can blow air at an angle approximately tangential to the outer surface of fuser, and when in the second position, the air outlet can blow air at an angle non-tangential to the outer surface of the fuser. Further, in other embodiments, when in the first position, the air outlet can blow air having a first velocity at the first angle, and when in the second position, the air outlet can blow air having a second velocity (more or less than the first velocity) at the second angle.

When in the first position, the air outlet blows air in a direction that lifts a leading edge of the sheet of print media off the outer surface of the heating device, and when in the second position, the air outlet blows air in a direction that maintains a central portion of the sheet of print media off the outer surface of the heating device.

These and other features are described in, or are apparent from, the following detailed description.

BRIEF DESCRIPTION OF THE DRAWINGS

Various exemplary embodiments of the systems and methods are described in detail below, with reference to the attached drawing figures, in which.

DETAILED DESCRIPTION

The embodiments herein are useful with printing/copying devices that use, such as those discussed in U.S. Patent Application 2003/0039491, the complete disclosure of which is incorporated herein by reference, and portions of which are incorporated herein.

This invention relates to a printing system which is used to produce color output in a single pass of a photoreceptor belt. It will be understood, however, that it is not intended to limit the invention to the embodiment disclosed. On the contrary, it is intended to cover all alternatives, modifications and equivalents as may be included within the spirit and scope of the invention as defined by the appended claims, including a multi-pass color process system, a single or multiple pass highlight color system, an ink jet system, and a black and white printing system.

Figure 7:
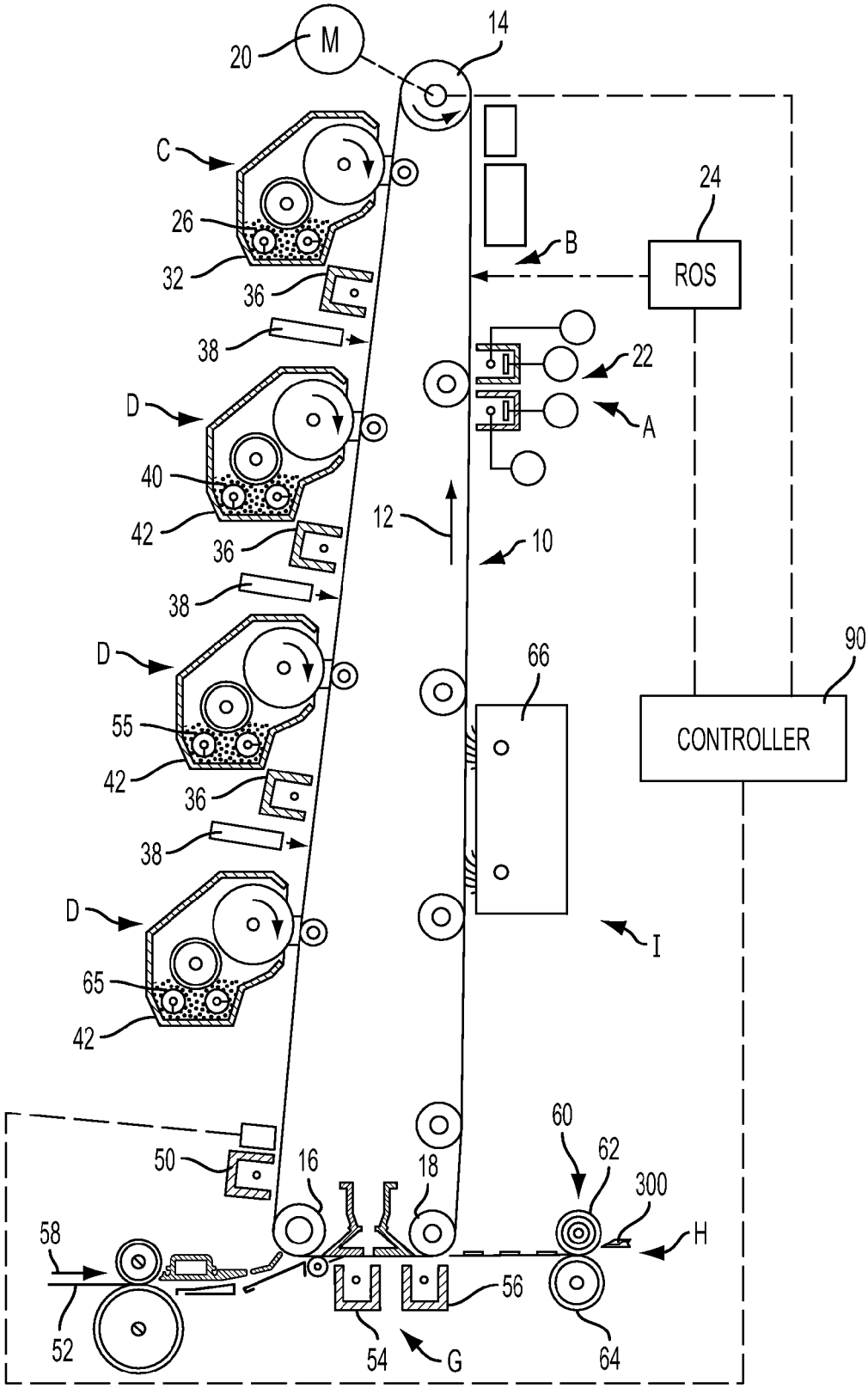
FIG. 7 is a schematic elevational view of a full color image-on-image single-pass electrophotographic printing machine utilizing the device described herein.

Turning now to FIG. 7, a electrophotographic printing machine uses a charge retentive surface in the form of an Active Matrix (AMAT) photoreceptor belt 10 supported for movement in the direction indicated by arrow 12, for advancing sequentially through the various xerographic process stations. The belt is entrained about a drive roller 14 and tension and steering rollers 16 and 18 respectively, roller 14 is operatively connected to a drive motor 20 for effecting movement of the belt through the xerographic stations.

With continued reference to FIG. 7, a portion of belt 10 passes through charging station A where a corona generating device, indicated generally by the reference numeral 22, charges the photoconductive surface of belt 10 to a relative high, substantially uniform, preferably negative potential.

Next, the charged portion of photoconductive surface is advanced through an imaging station B. At exposure station B, the uniformly charged belt 10 is exposed to a laser based output scanning device 24 which causes the charge retentive surface to be discharged in accordance with the output from the scanning device. The scanning device can be a laser Raster Output Scanner (ROS). Alternatively, the ROS could be replaced by other xerographic exposure devices such as LED arrays.

The photoreceptor, which is initially charged to a voltage $V_c$, undergoes dark decay to a level $V_{ddp}$ equal to about −500 volts. When exposed at the exposure station B it is discharged to $V_{image}$ equal to about −50 volts. Thus after exposure, the photoreceptor contains a monopolar voltage profile of high and low voltages, the former corresponding to charged areas and the latter corresponding to discharged or image areas.

At a first development station C, developer structure, indicated generally by the reference numeral 32 utilizing a hybrid jumping development (HJD) system, the development roll, better known as the donor roll, is powered by two development fields (potentials across an air gap). The first field is the AC jumping field which is used for toner cloud generation. The second field is the DC development field which is used to control the amount of developed toner mass on the photoreceptor. The toner cloud causes charged toner particles 26 to be attracted to the electrostatic latent image. Appropriate developer biasing is accomplished via a power supply. This type of system is a noncontact type in which only toner particles (magenta, for example) are attracted to the latent image and there is no mechanical contact between the photoreceptor and a toner delivery device to disturb a previously developed, but unfixed, image.

The developed but unfixed image is then transported past a second charging device 36 where the photoreceptor and previously developed toner image areas are recharged to a predetermined level.

A second exposure/imaging is performed by imaging device 38 which comprises a laser based output structure and is utilized for selectively discharging the photoreceptor on toned areas and/or bare areas, pursuant to the image to be developed with the second color toner. At this point, the photoreceptor contains toned and untoned areas at relatively high voltage levels and toned and untoned areas at relatively low voltage levels. These low voltage areas represent image areas which are developed using discharged area development (DAD). To this end, a negatively charged, developer material 40 comprising color toner is employed. The toner, which by way of example may be yellow, is contained in a developer housing structure 42 disposed at a second developer station D and is presented to the latent images on the photoreceptor by way of a second HSD developer system. A power supply (not shown) serves to electrically bias the developer structure to a level effective to develop the discharged image areas with negatively charged yellow toner particles 40.

The above procedure is repeated for a third image for a third suitable color toner such as cyan and for a fourth image and suitable color toner such as black. The exposure control scheme described below may be utilized for these subsequent imaging steps. In this manner a full color composite toner image is developed on the photoreceptor belt.

To the extent to which some toner charge is totally neutralized, or the polarity reversed, thereby causing the composite image developed on the photoreceptor to consist of both positive and negative toner, a negative pre-transfer dicorotron member 50 is provided to condition the toner for effective transfer to a substrate using positive corona discharge.

Subsequent to image development a sheet of support material 52 is moved into contact with the toner images at transfer station G. The sheet of support material is advanced to transfer station G by a sheet feeding apparatus to the pretransfer device which directs the advancing sheet of support material into contact with photoconductive surface of belt 10 in a timed sequence so that the toner powder image developed thereon contacts the advancing sheet of support material at transfer station G.

Transfer station G includes a transfer dicorotron 54 which sprays positive ions onto the backside of sheet 52. This attracts the negatively charged toner powder images from the belt 10 to sheet 52. A detack dicorotron 56 is provided for facilitating stripping of the sheets from the belt 10.

After transfer, the sheet continues to move, in the direction of arrow 58, onto a conveyor (not shown) which advances the sheet to fusing station H. Fusing station H includes a fuser assembly, indicated generally by the reference numeral 60, which permanently affixes the transferred powder image to sheet 52. The fuser assembly 60 comprises a heated fuser roller 62 and a backup or pressure roller 64. Sheet 52 passes between fuser roller 62 and backup roller 64 with the toner powder image contacting fuser roller 62. In this manner, the toner powder images are permanently affixed to sheet 52 after it is allowed to cool. After fusing, the sheet is separated from the fuser roll by the corrugating air knife, described in more detail below, to a chute which guides the advancing sheets 52 to a catch tray for subsequent removal from the printing machine by the operator.

After the sheet of support material is separated from photoconductive surface of belt 10, the residual toner particles carried by the non-image areas on the photoconductive surface are removed therefrom. These particles are removed at cleaning station I using a cleaning brush structure contained in a housing 66.

Figure 8:
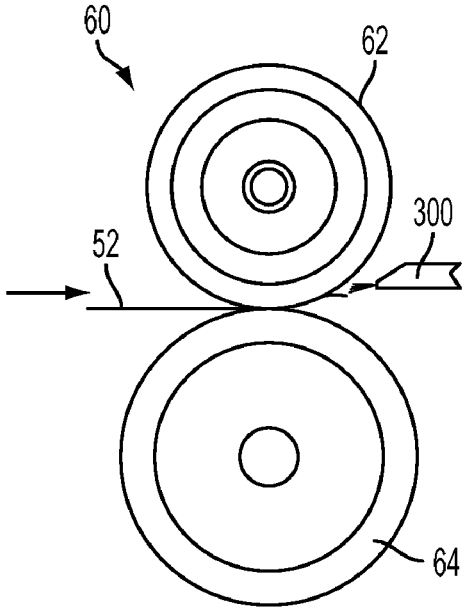
FIG. 8 is a side view illustrating a prior art fusing device with an air knife relative to the FIG. 7 printing machine.
Figure 9:
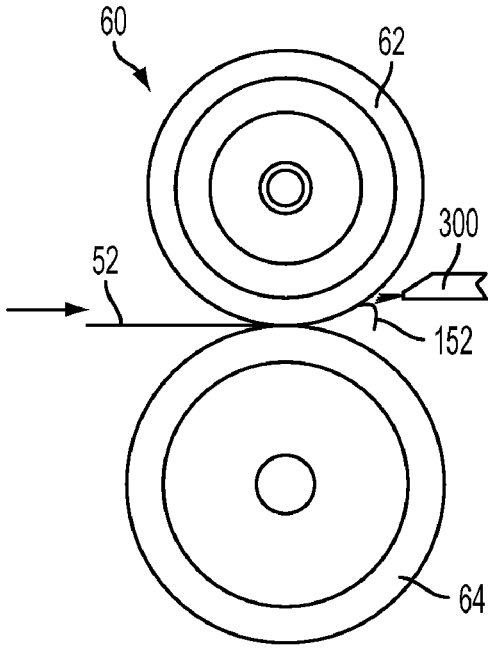
FIGS. 9 and 10 are side views illustrating a fault that can occur with the prior art fusing device and method relative to the FIG. 7 printing machine.
Figure 10:
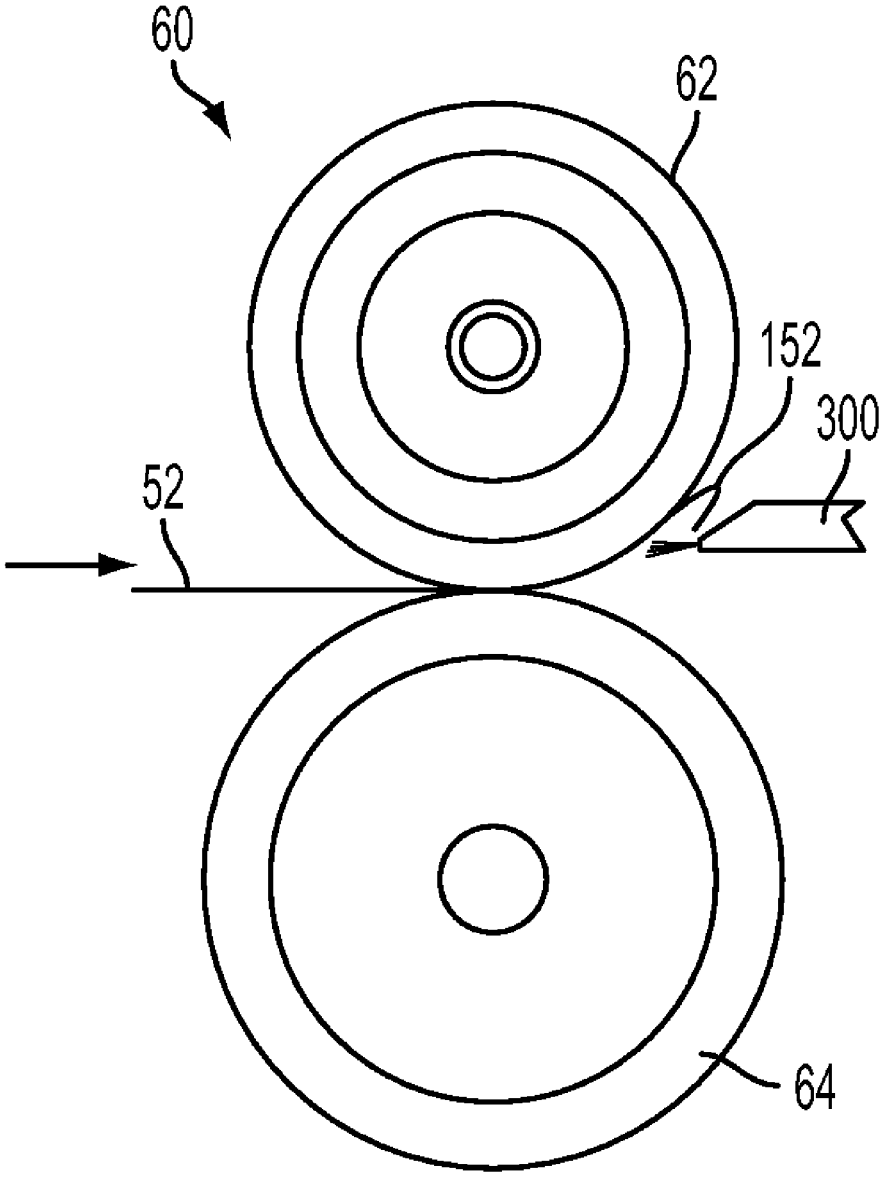

As shown in FIG. 8, the sheet 52 passes between the heated roll 62 and the pressure roll 64 causing the toner image thereon to be fused to the sheet. An air knife 300 provides a stream of air to assist in separating the fused sheet from the heated fuser roll. With lighter weight sheets with a heavy toner image near the lead edge 152 of the sheet, the sheet sometimes might either not separate from the fuser or, due to the lack of beam strength of the sheet, might retack to the fuser roll and cause a jam. As shown in FIGS. 9 and 10, the air blast from the air knife on a light weight sheet would cause the lead edge of the sheet to fold over while the imaged area "retacked" to the fuser roll 62. This would cause the sheet to wrap around the fuser roll 62 causing a jam as opposed to exiting through the sheet guide.

Figure 1:
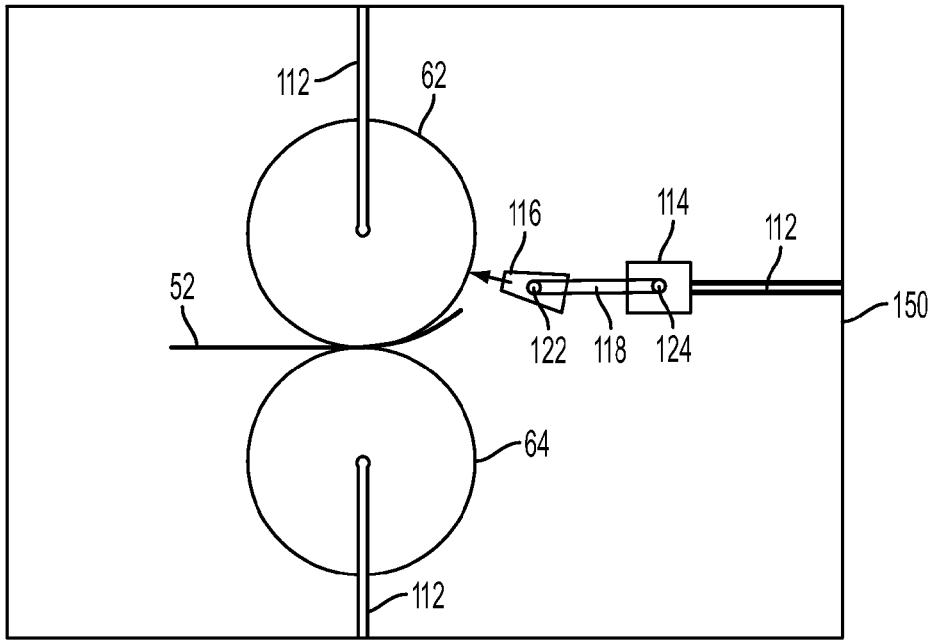
FIGS. 1-3 are side views illustrating a fuser assembly having an air knife according to embodiments herein.
Figure 2:
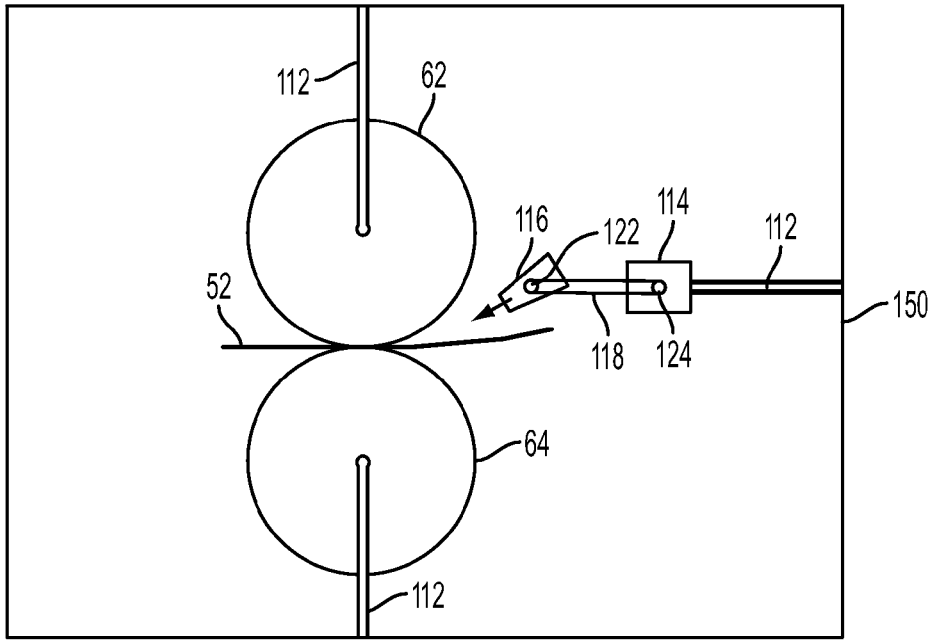

Referring now to FIG. 1-6, embodiments herein include an apparatus that can comprise any heating device 62, such as one having an outer surface adapted to contact items, such as sheets of print media 52, and a rotatable air outlet 116 (vent, jet, blower, etc.) positioned next to the heating device 62. The air outlet 116 can have a length at least as long as the width as the fuser 62. The rotatable air outlet 116 can be positioned to blow air to remove the items from the heating device 62 and can rotate from a first position (FIG. 1) to a different second position (FIGS. 2 and/or 3).

Figure 3:
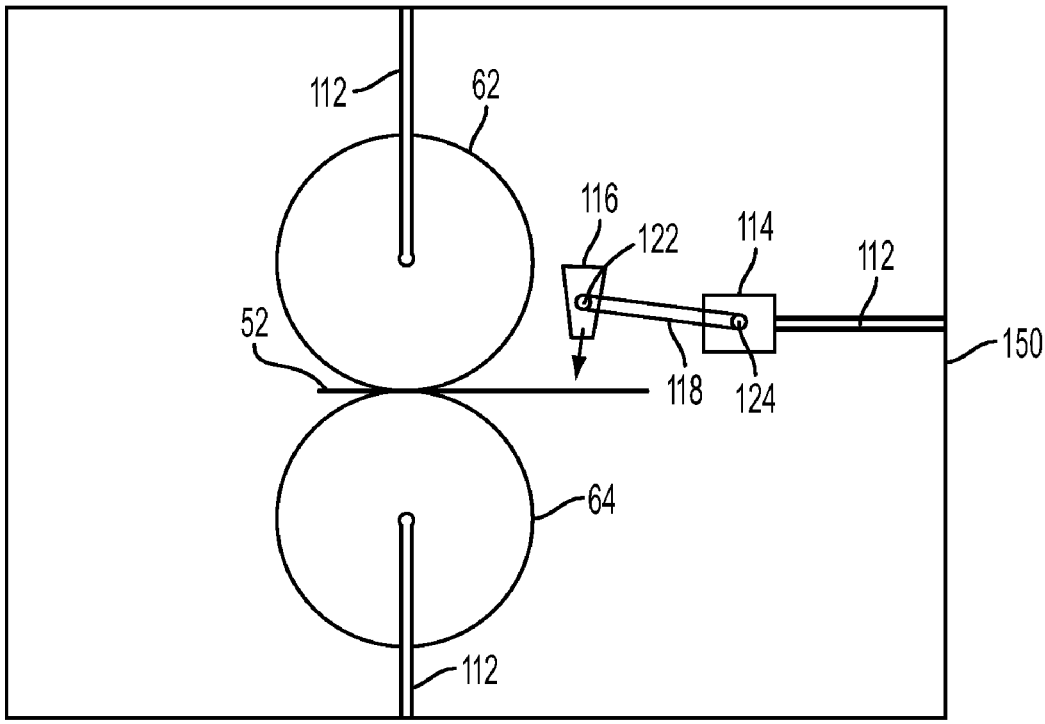

In a more specific embodiment, the apparatus can comprise a fuser 62 that has an outer surface adapted to contact sheets of print media 52, and the rotatable air outlet 116 can be positioned next to the fuser 62. FIGS. 1-3 also illustrate the apparatus 150 (copier, printing device, etc.) in which the rotatable air outlet 116 is positioned and the various frame members 112 that support the different structures within the apparatus 150.

Thus, as shown in FIG. 1, as the print media 52 begins to move through the nip created by the fuser 62 and the pressure roller 64, the air outlet 116 blows air directly against the fuser 62 (e.g., at an angle approximately tangential to the surface of the fuser 62). The force of the air from the air outlet 116 causes the leading edge of the print media 52 to begin to separate from the fuser 62. A few moments later the print media 52 has traveled further through the nip between the user 62 and the pressure roller 64, and the air outlet 116 begins to rotate downward so that the air outlet 116 blows at a non-tangential angle to the surface of the fuser 62, as shown in FIG. 2. This causes the air outlet 116 to blow more toward the center section of the print media 52. This action continues to cause of the print media 52 to be removed from the surface of the fuser 62 and prevents the print media 52 from folding back or retacking, as shown above in FIG. 10. As the print media 52 moves even further through the nip, the air outlet 116 continues to rotate downward, thereby continuing to remove the print media from the surface of the fuser 62, as shown in FIG. 3.

As described above, the rotatable air outlet 116 or "air knife" is positioned with respect to the fuser so as to blow air to remove the sheets of print media 52 from the fuser 62. The air outlet 116 can further comprise, or be connected to, an actuator 114. Further, the actuator 114 can include or be connected to a controller which is also represented by item 114. The actuator can comprise a motor, a motor driven belt apparatus 118, 122, 124, and/or any other device that can cause the air outlet 116 to rotate. In the examples shown in FIGS. 1-3 items 122 and 124 represent pulleys and item 118 represents a drive belt. As mentioned above, item 114 can represent the actuator/controller and can also represent the drive motor which rotates the pulley 124. Alternatively, item 116 can include an internal motor which causes the air outlet 116 to rotate around the axle 122, in which case items 118, 114, and 124 can be omitted. The controller can be adapted to actuate the actuator to rotate the air outlet 116 from the first position to the second position.

The air outlet 116 is at least as long as the width of the fuser. This allows the air to be blown along the entire width of the fuser, which prevents delta-gloss defects that can be caused by local cooling effects on the fuser roll.

Thus, as mentioned above, when in the first position, the air outlet 116 blows air in a direction that lifts the leading edge of the sheet of print media 52 off the outer surface of the heating device 62, and when in the second position, the air outlet 116 blows air in a direction that maintains a central portion of the sheet of print media 52 off the outer surface of the heating device 62. After the print media 52 passes through the nip created by the fuser 62 and pressure roller 64, the air outlet 116 returns to the initial position shown in FIG. 1. Therefore, as sheets of print media 52 pass through the nip, the air outlet 116 oscillates from the initial position (FIG. 1) to a finishing position (FIG. 3) and back, so as to lift the sheets of print media 52 off the surface of the fuser 62.

While the example shown in FIGS. 1-3 illustrates an embodiment that begins by blowing air approximately tangential to the surface of the user 62, as would be understood by one ordinarily skilled in the art in light of this disclosure, the air outlet 116 can be initially positioned at non-tangential angles, if such initial angles are more useful (more effective) at causing the leading edge of the print media 52 to separate from the user 62. Thus, the embodiments herein are not limited to a rotating air outlet that only begins oscillations at an initial angle tangential to the surface of the fuser 62, but instead, any initial angle can be utilized by embodiments herein depending upon the specific characteristics of the device 150 and type of print media 52 it will be processing.

Similarly, while an approximate 90 degree rotation is illustrated from the initial position shown in FIG. 1 to the final position shown in FIG. 3, again one ordinarily skilled in the art would understand that the air outlet 116 can rotate (oscillate) through any amount of rotation (such as 75-120 degrees; 1-180 degrees, etc.). Again, the amount of rotation seen by the air outlet 116 will depend on the specific device 150 in which it operates and the type of print media it will be subjected to, and the invention is not limited to the angles shown in the drawings.

Also, the air outlet 116 can rotate differently depending upon the specific print media being used. Different types of print media will have different characteristics, such as thickness, roughness, moisture content, etc. Print devices can receive inputs regarding the type of print media loaded or can automatically detect the nature of the print media being processed. Thus, the air outlet 116 can rotate through a smaller angle range (rotate less) for a first type of print media and rotate through a larger angle range (rotate more) for a second type of media. In addition, the air outlet can rotate only for specific types of print media and not rotate for other types of media. The different amounts of rotation are controlled by the controller 114.

In additional embodiments, the air blown by the air outlet 116 can be heated or non-heated using any type of heating device (e.g., resistive heater). Again, different types of media can receive different amounts of heating.

Also, the air outlet 116 could comprise a multi-velocity air outlet, such as that disclosed in U.S. Patent Application Publication 2003/0039491 (discussed above). Thus, when in the first position, the air outlet 116 can blow air having a first velocity at the first angle, and when in the second position, the air outlet 116 can blow air having a second velocity (more or less than the first velocity) at the second angle.

Figure 4:
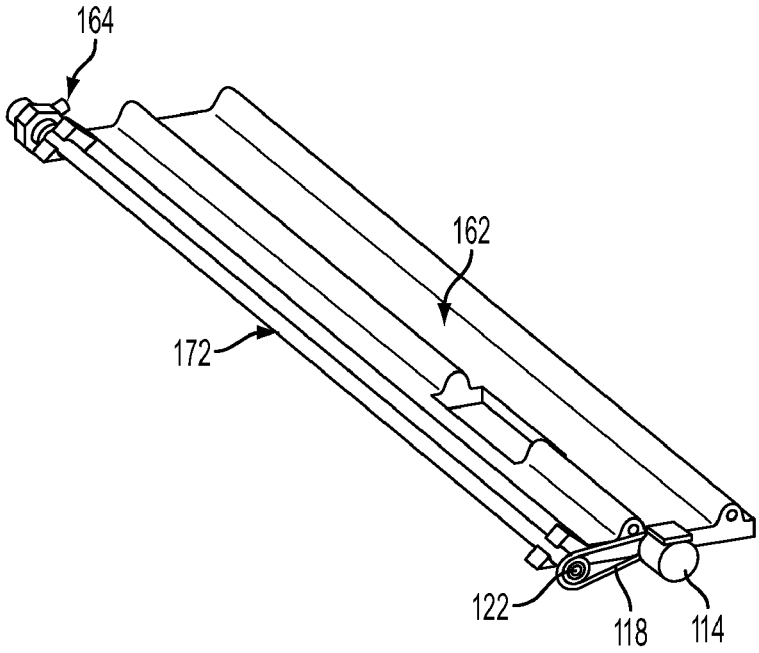
FIG. 4 is a schematic perspective view of a frame and air plenum having a rotating air outlet according to embodiments herein.
Figure 5:
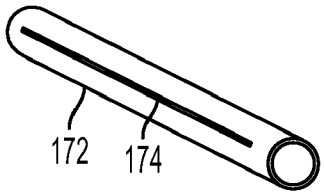
FIGS. 5 and 6 are schematic perspective views of a tube shaped air plenum having different types of air outlets according to embodiments herein.
Figure 6:
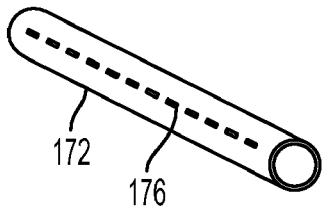

The air outlet 116 can be, in one embodiment, part of a tube-shaped air plenum 172, as shown in FIGS. 4-6. For example, as shown in FIG. 4, the tube-shaped air plenum is mounted on a frame 162 and includes a connection 164 to which an air pressure line can be attached. One specific non-limiting arrangement of the actuator 114, drive belt 118 and pulley 122 is also shown in FIG. 4.

FIGS. 5 and 6 illustrate some different configurations of the tube-shaped air plenum 172. The tube-shaped air plenum 172 shown in FIG. 5 includes one or more slit openings 174 through which the air would be directed toward the fuser 62 and the tube-shaped air plenum 172 shown in FIG. 6 includes a pattern of openings 176 (perforations, jets, etc.) through which the air would be directed toward the fuser 62. Again, the types of openings used are not limited to these examples, and any form of opening is included with the embodiments described herein.

The word "printer" or "image output terminal" as used herein encompasses any apparatus, such as a digital copier, bookmaking machine, facsimile machine, multi-function machine, etc. which performs a print outputting function for any purpose. The details of printers, printing engines, etc. are well-known by those ordinarily skilled in the art and are discussed in, for example, U.S. Pat. No. 6,032,004, the complete disclosure of which is fully incorporated herein by reference. The embodiments herein can encompass embodiments that print in color, monochrome, or handle color or monochrome image data. All foregoing embodiments are specifically applicable to electrostatographic and/or xerographic machines and/or processes.

It will be appreciated that the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims. The claims can encompass embodiments in hardware, software, and/or a combination thereof. Unless specifically defined in a specific claim itself, steps or components of the invention should not be implied or imported from any above example as limitations to any particular order, number, position, size, shape, angle, color, or material.

What is claimed is:

1. An apparatus comprising:

a heating device having an outer surface adapted to contact sheets of print media;

a rotatable air outlet positioned next to said heating device, said rotatable air outlet being positioned to blow air to remove said sheets of print media from said heating device; and an actuator connected to said air outlet, wherein said actuator comprises one of a motor and a motor driven belt apparatus, wherein said rotatable air outlet is adapted to rotate from a first position to a different second position.

2. The apparatus according to claim 1, wherein, when in said first position, said air outlet blows air in a direction that lifts a leading edge of a sheet of print media off said outer surface of said heating device, and wherein, when in said second position, said air outlet blows air in a direction that maintains a central portion of said sheet of print media off said outer surface of said heating device.

3. The apparatus according to claim 1, wherein said air outlet comprises a rotatable tube-shaped air plenum having at least one opening.

4. The apparatus according to claim 1, wherein said apparatus comprises one of an electrostatic and xerographic printing apparatus.

5. An apparatus comprising:

a fuser having an outer surface adapted to contact sheets of print media;

a rotatable air outlet positioned next to said fuser, said rotatable air outlet being positioned to blow air to remove said sheets of print media from said fuser; and an actuator connected to said air outlet, wherein said actuator comprises one of a motor and a motor driven belt apparatus, wherein said rotatable air outlet is adapted to rotate from a first position to a second position, wherein, when in said first position, said air outlet blows air at a first angle directly toward said outer surface of fuser, and wherein, when in said second position, said air outlet blows air at a second angle not directly toward said outer surface of said fuser.

6. The apparatus according to claim 5, wherein, when in said first position, said air outlet blows air in a direction that lifts a leading edge of a sheet of print media off said outer surface of said heating device, and wherein, when in said second position, said air outlet blows air in a direction that maintains a central portion of said sheet of print media off said outer surface of said heating device.

7. The apparatus according to claim 5, wherein said air outlet comprises a rotatable tube-shaped air plenum having at least one opening.

8. The apparatus according to claim 5, wherein said apparatus comprises one of an electrostatic and xerographic printing apparatus.

9. An apparatus comprising:

a fuser having an outer surface adapted to contact sheets of print media;

a rotatable air outlet positioned next to said fuser, said rotatable air outlet being positioned to blow air to remove said sheets of print media from said fuser, wherein said air outlet comprises one of a slit and perforations and said air outlet has a length at least as long as a width as said fuser;

an actuator connected to said air outlet; and a controller connected to said actuator, wherein said controller is adapted to actuate said actuator to rotate said air outlet from a first position to a second position, wherein, when in said first position, said air outlet blows air at an angle approximately tangential to said outer surface of fuser, wherein, when in said second position, said air outlet blows air at an angle non-tangential to said outer surface of said fuser, and wherein said actuator comprises one of a motor and a motor driven belt apparatus.

10. The apparatus according to claim 9, wherein, when in said first position, said air outlet blows air in a direction that lifts a leading edge of a sheet of print media off said outer surface of said heating device, and wherein, when in said second position, said air outlet blows air in a direction that maintains a central portion of said sheet of print media off said outer surface of said heating device.

11. The apparatus according to claim 9, wherein said air outlet comprises a rotatable tube-shaped air plenum having at least one opening.

12. The apparatus according to claim 9, wherein said apparatus comprises one of an electrostatic and xerographic printing apparatus.

13. An apparatus comprising:

a fuser having an outer surface adapted to contact sheets of print media;

a rotatable air outlet positioned next to said fuser, said rotatable air outlet being positioned to blow air to remove said sheets of print media from said fuser; and an actuator connected to said air outlet, wherein said actuator comprises one of a motor and a motor driven belt apparatus, wherein said rotatable air outlet is adapted to rotate from a first position to a second position, wherein, when in said first position, said air outlet blows air having a first velocity at a first angle directly toward said outer surface of fuser, and wherein, when in said second position, said air outlet blows air having a second velocity less than said first velocity at a second angle not directly toward said outer surface of said fuser.

14. The apparatus according to claim 13, wherein, when in said first position, said air outlet blows air in a direction that lifts a leading edge of a sheet of print media off said outer surface of said heating device, and wherein, when in said second position, said air outlet blows air in a direction that maintains a central portion of said sheet of print media off said outer surface of said heating device.

15. The apparatus according to claim 13, wherein said air outlet comprises a rotatable tube-shaped air plenum having at least one opening.

16. The apparatus according to claim 13, wherein said apparatus comprises one of an electrostatic and xerographic printing apparatus.

* * * * *